US006533637B1

(12) United States Patent
Liao

(10) Patent No.: US 6,533,637 B1
(45) Date of Patent: Mar. 18, 2003

(54) IMPACT EXPANDING PROJECTILE DEVICE AND ITS ASSOCIATED METHOD OF MANUFACTURE

(76) Inventor: Chu-Yuan Liao, 17F, No 102, Sec 2 Roosevelt Road, Taipei (TW)

( * ) Notice: Subject to any disclaimer, the term of this patent is extended or adjusted under 35 U.S.C. 154(b) by 0 days.

(21) Appl. No.: 10/188,822

(22) Filed: Jul. 5, 2002

Related U.S. Application Data

(63) Continuation-in-part of application No. 09/945,739, filed on Sep. 5, 2001, now abandoned.

(51) Int. Cl.[7] ..... A63B 43/00

(52) U.S. Cl. ..... 446/267; 446/486; 473/574; 473/594

(58) Field of Search ..... 473/573, 574, 473/594, 609, 614; 446/71, 74, 267, 486

(56) References Cited

U.S. PATENT DOCUMENTS 3,601,923 A * 8/1971 Rosenberg ..... 446/267
3,676,387 A * 7/1972 Lindlof ..... 524/489
4,236,715 A * 12/1980 Middlebrook ..... 473/574
4,952,190 A * 8/1990 Tarnoff et al. ..... 446/267
5,066,018 A * 11/1991 Hinton ..... 473/572
5,975,983 A * 11/1999 Panec ..... 446/475
5,984,812 A * 11/1999 Sassak ..... 473/596
6,109,998 A * 8/2000 DiResta et al. ..... 446/184

* cited by examiner

*Primary Examiner*—Jacob K. Ackun
(74) *Attorney, Agent, or Firm*—LaMorte & Associates

(57) ABSTRACT

A toy projectile device that is thrown at flat surfaces, such as pains of glass. The toy projectile has a volume of fill material that is encapsulated within a thin-walled shell. The fill material contains a liquid and may contain solid objects suspended within the liquid. The shell is fabricated from an elastomeric material that is highly elastic, has high tear resistance and has a tacky exterior. When the toy projectile is thrown against a hard surface, the thin-walled shell deforms on impact and stretches into a splat pattern on the impacted surface. Due to the tackiness of the shell, the shell adheres to the impacted surface in the splat pattern. After a short period of time, the elastic properties of the shell cause the shell to contract and peel way from the impacted surface.

20 Claims, 6 Drawing Sheets

IMPACT EXPANDING PROJECTILE DEVICE AND ITS ASSOCIATED METHOD OF MANUFACTURE

RELATED APPLICATIONS

This application is a continuation-in-part of now abandoned patent application Ser. No. 09/945,739, filed Sep. 5, 2001, entitled Throwing Toy With High Softness And Adhesion.

BACKGROUND OF THE INVENTION

1. Field of the Invention

The present invention relates to toy projectile devices and the methods used in the fabrication of such devices. More particularly, the present invention relates to projectile devices that adhere to the surface against which they are thrown.

2. Prior Art Statement

The field of toys is replete with various types of projectile devices. Many of these projectile devices are specifically designed to adhere to a particular type of target surface. For example, in the game of darts, each dart projectile has a sharpened point. The dartboard used in the game of darts is specifically designed to receive the sharpened point of a dart projectile and retain that dart projectile in place at the point of impact. There are also a wide variety of games that come with a target field and target projectiles that both contain hook and loop material, such as Velcro. When the target projectile is thrown against the target field, the target projectile adheres to the target field at the point of impact. Other games include games that use magnet tipped projectiles and metallic target fields. Again, when the magnetic tipped projectile strikes the metallic field, the projectile adheres to the metallic field at the point of impact.

In the field of toys, there are also many projectiles that are designed to adhere to a wide variety of surfaces, rather than to a dedicated target surface. For example, many projectiles contain suction cups that can adhere to any smooth surface. Other projectiles are made of tacky material that enables the projectiles to adhere to semi-smooth surfaces such as walls and ceilings.

Toy projectiles that adhere to a wide variety of surfaces tend to have a wider play appeal than do toy projectiles that adhere only to dedicated surfaces. This is especially true with young children who lack the coordination to throw a projectile accurately against a dedicated target surface. However, when manufacturing toy projectiles that can adhere to many surfaces, the toy projectile tends to be made to have a low weight-to-size, density. With a low weight-to-size density, prior art projectiles tend to be lightweight and/or soft. With such characteristics, the toy projectile will not readily break a pane of glass, or hurt another child if thrown against such things. However, since the toy projectiles are generally made to be light and have a low density, they typically have poor aerodynamic properties. Consequently, due to wind resistance, such projectiles typically can only be thrown short distances, regardless of how hard they are thrown. Furthermore, wind resistance also such projectiles travel at slow speeds when they are thrown. These characteristics lower the play value of the toy projectile.

The present invention is a new type of toy projectile that can adhere to most any surface yet has a relatively high weight-to-size density. Consequently, the toy projectile can be thrown long distances at high speeds. However, the toy projectile deforms significantly upon impact with most any surface. The deformation spreads the energy of the impact across a wide area. This makes the toy projectile safe to throw against fragile objects, such as panes of glass. The extreme deformation created at the time of impact remains for a short period of time, whereinafter the projectile returns to its original size and shape. The structure of the present invention projectile and its associated method of manufacture are described and claimed below.

SUMMARY OF THE INVENTION

The present invention is a toy projectile device that is thrown at flat surfaces, such as panes of glass. The toy projectile has a volume of fill material that is encapsulated within a thin-walled shell. The fill material contains a liquid and may contain solid objects suspended within the liquid. The shell is fabricated from an elastomeric material that is highly elastic, has high tear resistance and has a tacky exterior. When the toy projectile is thrown against a hard surface, the thin-walled shell deforms on impact and stretches into a splat pattern on the impacted surface. Due to the tackiness of the shell, the shell adheres to the impacted surface in the splat pattern. This provides an illusion that the shell has ruptured and that the contents of the toy projectile are splattered against the impacted object. However, the shell of the toy projectile is not ruptured, rather it is only deformed. After a short period of time, the elastic properties of the shell cause the shell to contract and peel away from the impacted surface. The shell eventually returns to its original orientation, wherein it is again ready to be thrown.

BRIEF DESCRIPTION OF THE DRAWINGS

For a better understanding of the present invention, reference is made to the following descriptions of exemplary embodiments thereof, considered in conjunction with the accompanying drawings, in which.

DETAILED DESCRIPTION OF THE DRAWINGS

Figure 1:
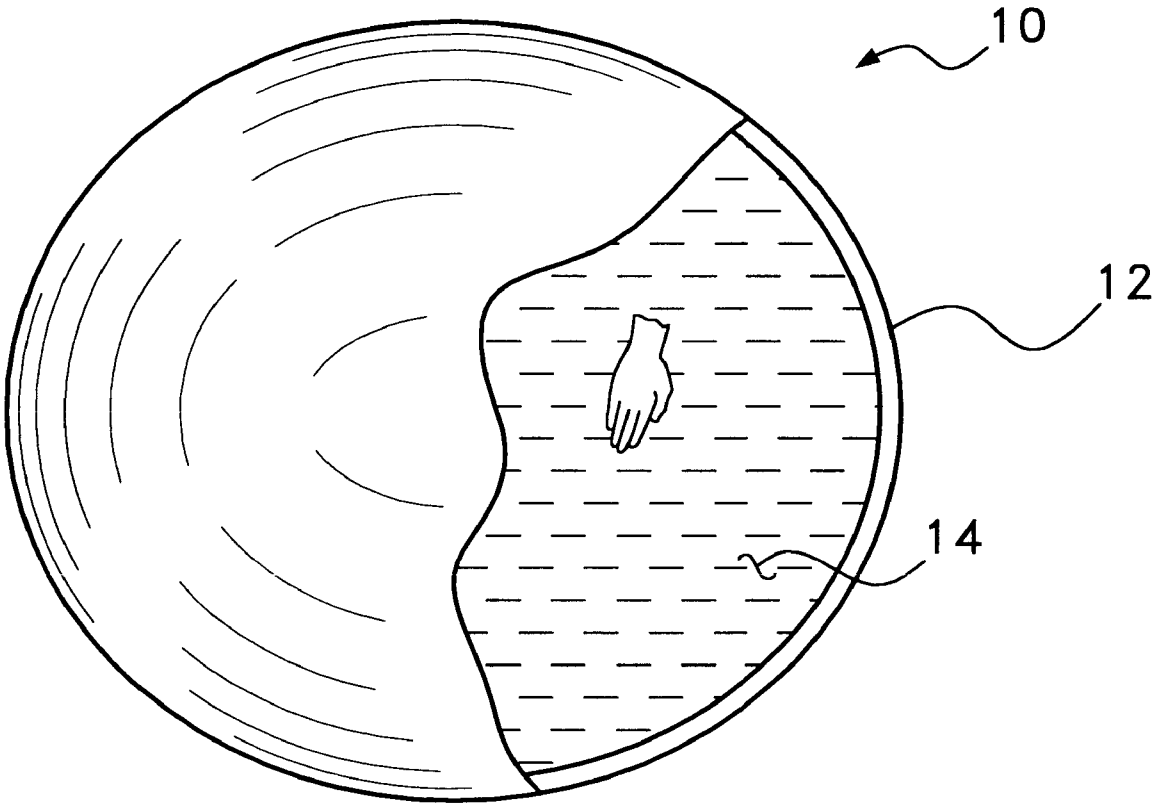
FIG. 1 is a partially fragmented view of a first exemplary embodiment of a toy projectile in accordance with the present invention.

Referring to FIG. 1, an exemplary embodiment or the present invention projectile device 10 is shown. The projectile device 10 is comprised of an elastomeric shell 12 that is filled with a fill material 14. The fill material 14 can be all liquid or can be a suspension that contains solid elements suspended in a fluid medium, as will later be explained.

The elastomeric shell 12 of the projectile device 10 is both highly elastic and has a high tear resistance. As such, the material of the elastomeric shell 12 is capable of stretching a great distance without tearing. The thickness of the walls of the shell are typically between 0.2 millimeters and 1 millimeter when unstressed. Such wall thickness can be reduced up 500% without breaking when the walls are stretched or otherwise stressed.

The elastomeric shell 12 of the projectile device 10 has three primary characteristics that make it work as part of the present invention. First, the elastomeric shell 12 must be highly elastic so that it can readily stretch when stressed. Second, the elastomeric shell 12 must have a high resistance to tearing. In this manner, the elastomeric shell will not tear when it stretches. Lastly, the elastomeric shell 12 must be tacky so that the elastomeric shell 12 will adhere to most surfaces against which it impacts. A suitable material for the elastomeric shell 12 is a tri-block copolymer such as poly (styrene-ethylene-butylene-styrene) or poly(styrene-ethylene-propylene-styrene), however, other copolymers and other thermoplastic elastomers can be used. The copolymer is mixed with a plasticizing oil to form a highly elastic semi-solid gel. The gel is highly elastic and has a high resistance to tearing. Tackiness can be added to the elastomeric material in one of two ways. In a preferred method, a tacky resin is mixed with the copolymer and the plasticizing oil. This provides the elastomeric material with a uniform tackiness than cannot be washed away. In an alternative embodiment, the elastomeric material can be coated with a tacky substance after the elastomeric material is formed into the shell 12 of the projectile device 10.

Examples of acceptable plasticizing oils include, but are not limited to, polybutenes and hydrogenated polybutenes. The plasticizing oils are added to the copolymer in an amount between 50 parts and 1500 parts by weight per 100 parts of copolymer.

Examples of acceptable tacky resins include, but are not limited to, Wingtack and Piccolyte tackifier resins. The tacky resin is added to the copolymer in preferably between 10 parts and 150 parts per weight per 100 parts copolymer.

In the embodiment of FIG. 1, the elastomeric shell 12 is shown having a generally ball shape. Such a shape is merely exemplary and it should be understood that the elastomeric shell 12 can be manufactured into any desired shape. For instance, the elastomeric shell 12 can be formed as another object; such as an animal, airplane, football or the like.

Figure 2:
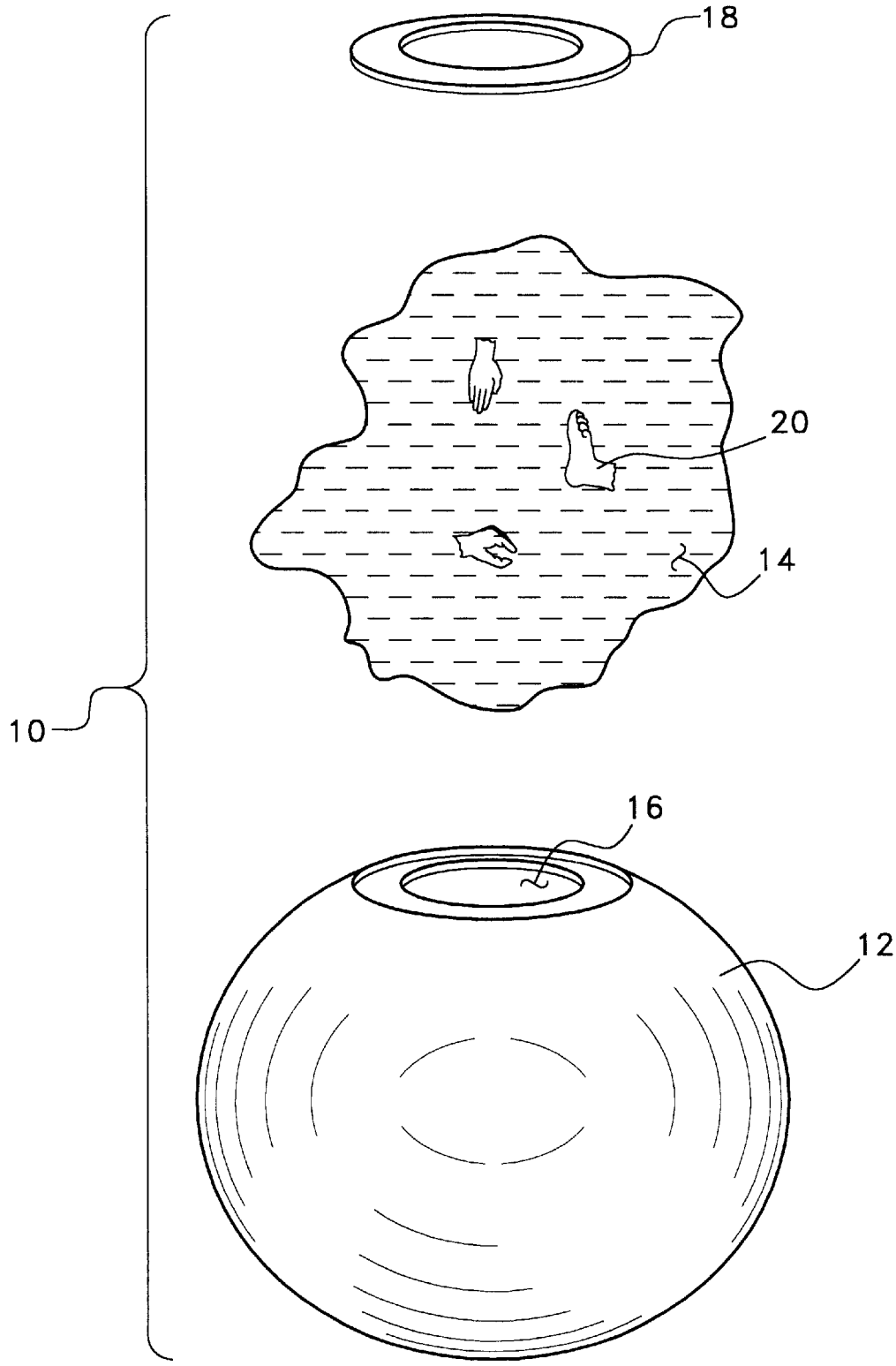
FIG. 2 is an exploded view of the embodiment of the toy projectile shown in FIG. 1.

Referring to FIG. 2, it can be seen that the elastomeric shell 12 of the projectile device 10 is filled with a fill material 14 and is then sealed closed. In the shown embodiment, the elastomeric shell 12 is filled through an aperture 16 that is sealed with a cap element 18 after the fill material 14 is added to the elastomeric shell 12. The cap element 18 is made of the same material as is the elastomeric shell 12 and is sealed into place using a heat bonding process and/or adhesive.

The fill material 14 is either all liquid or mostly liquid. The liquid used as part of the fall material 14 can be any liquid that does not react with the elastomeric material of the shell. Also, the liquid used as part of the fill material is preferably non-toxic and non-staining. This will prevent a child from getting hurt or property from getting stained should the elastomeric shell 12 of the device 10 ever become punctured or otherwise rupture.

In the shown embodiment of the invention, the fill material 14 contains objects 20 that are suspended within the liquid fill. These objects 20 are made of foam, elastomeric gel or some other soft material. The objects 20 can be created in any form provided the objects 20 do not have any sharp edges that can rupture the elastomeric shell 12 when biased against the material of the elastomeric shell 12.

Figure 3:
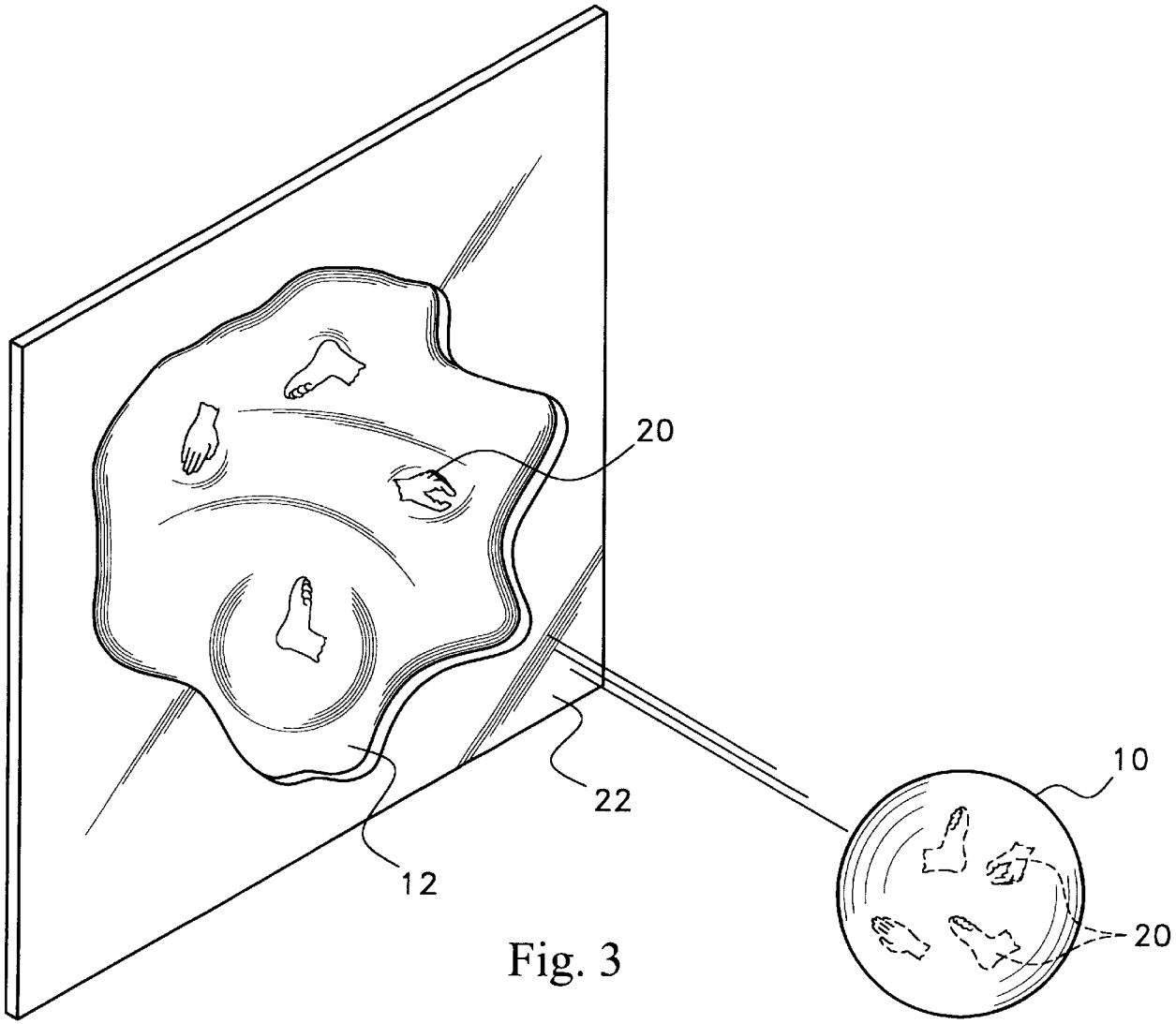
FIG. 3 is perspective view of the embodiment of the toy projectile shown in FIG. 1 shown both before and after impacting a flat surface.

Referring now to FIG. 3, it can be seen that when the projectile device 10 is thrown against any hard surface 22, the elastomeric shell 12 of the projectile device 10 deforms dramatically upon impact. The deformation is best if the projectile device 10 is thrown in excess of ten miles per hour. The elastomeric shell 12 of the projectile device 10 spreads against the impacted surface 22 and the entire projectile device 10 becomes flat, having a two-dimensional appearance. As such, when the projectile device 10 strikes a surface 22, it appears as though the elastomeric shell 12 has ruptured and that the contents of the projectile device 10 are splattered against the impacted surface 22. However, this is not reality. In reality, the elastomeric shell 12 has stretched thin against the impacted surface 22. Due to the tackiness of the elastomeric shell 12, the deformed elastomeric shell 12 sticks to the impacted surface 22 and maintains its fully distorted shape for a few seconds. However, after a few seconds, the elasticity of the elastomeric shell 12 overcomes the tacky adhesion and the elastomeric shell 12 begins to contract back into its original shape.

The degree to which the elastomeric shell deforms depends largely upon how hard the projectile device is thrown. A child typically can throw a projectile at a speed at least as great as ten miles per hour. The elasticity of the elastomeric shell 12 and the volume of fill material 14 are calculated so that the maximum cross-sectional area of the projectile device 10 will increase by at least fifty percent (50%), if the projectile device 10 impacts a flat surface at a speed of ten miles per hour. At higher speeds of impact, the maximum area of the distorted projectile device can be in excess of twice as large as the maximum cross-sectional area of the device before it is thrown.

As the elastomeric shell 12 stretches upon impact, it becomes thinner and therefore becomes more translucent. Furthermore, as the projectile device 12 strikes a surface 22, the fill material 14 (FIG. 2) within the elastomeric shell 12 becomes widely spread across the entire interior of the deformed shell. Consequently very little liquid is present between the objects 20 in the fill material and the stretched elastomeric shell 12. As a result, the objects 20 in the fill material become highly visible through the stretched walls of the elastomeric shell 12. Furthermore, the thickness of the objects 20 in the fill material is often thicker than the deformed width of the projectile device 10. This causes the objects 20 in the fill material to protrude from the stretched elastomeric shell 12, thereby becoming even more noticeable. It will therefore be understood, that if a colored liquid is used in the fill material that is not highly translucent, objects 20 contained within the fill material may not be visibly noticeable until the projectile device 10 is thrown against a hard surface 22 and the elastomeric shell 12 of the projectile device 10 stretches to reveal the objects 20 contained therein.

To use the present invention projectile device 10, the projectile device 10 is held in the hand and thrown. When the projectile device 10 hits a hard surface 22, it expands and temporarily adheres to the impacted surface 22 in its deformed state. If the projectile device 10 contains objects 20, those objects 20 become highly visible when the projectile device 10 is in its deformed state. This adds to the illusion that the elastomeric shell 12 of the projectile device 10 has ruptured and that the contents of the projectile device 10 are splattered against the impacted surface 22.

A similar optical illusion can also be obtained by selectively choosing the color of the material that makes the elastomeric shell 12 and the liquid in the fill material 14 (FIG. 2) that fills the elastomeric shell 12. If the material of the elastomeric shell 12 is colored, it may be opaque when not deformed. However, when the projectile device 10 strikes a surface 22, the elastomeric shell 12 stretches and becomes thin. At this time, the elastomeric shell 12 may become highly translucent. Consequently, if the material of the elastomeric shell 12 is colored one color and the liquid in the fill material is colored a second different color, the second color will only be visible when the projectile device 10 is deformed against a hard surface 22. As a result, when a person throws the projectile device 10 against a hard surface 22, it can appear to suddenly change colors. This adds to the illusion that the elastomeric shell 12 of the projectile device 10 has ruptured and that contents of the projectile device 10 are splattered against the impacted surface 22.

Figure 4:
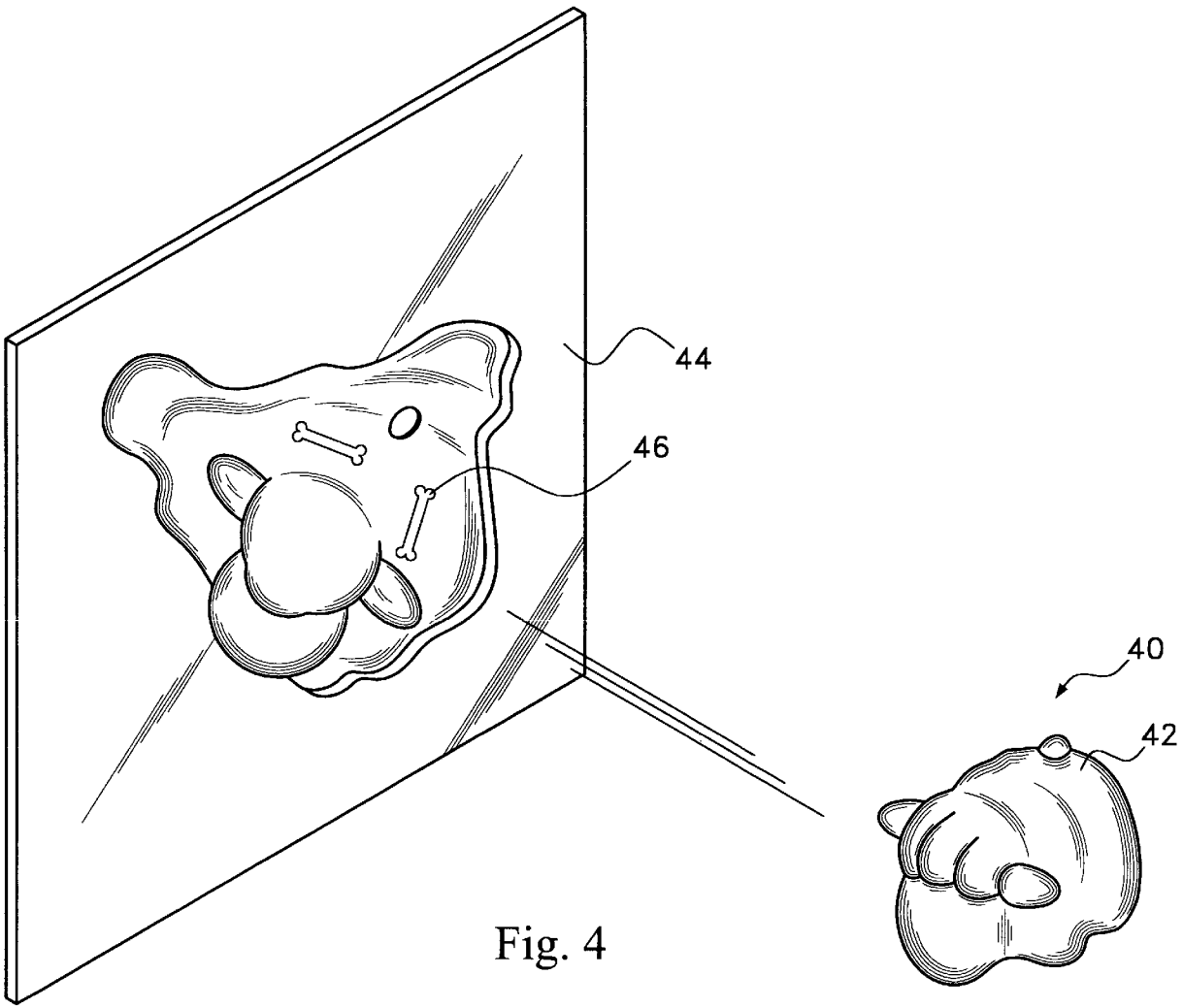
FIG. 4 is a perspective view of a second exemplary embodiment of a toy projectile shown both before and after impacting a flat surface.

It has been previously mentioned that the present invention projectile device 10 can be formed into many other shapes other than the shape of a ball. Referring to FIG. 4, such an embodiment is shown. In FIG. 4, the projectile device 40 has an elastomeric shell 42 made in the shape of an animal. In the shown instance, the animal is a sheep. However, the elastomeric shell 42 of the projectile device 40 is still made of the material previously described. Consequently, when the projectile device 40 is thrown against a hard surface 44, the animal-shaped elastomeric shell 42 widely deforms and adheres to the impacted surface 44. Objects 46, such as imitation bone, and various innards can be contained within the animal-shaped elastomeric shell 42. Such innards will only become visible after the animal-shaped elastomeric shell 42 deforms against the impacted surface 44. Consequently, the projectile device 40 will present the illusion that the animal shape being thrown has exploded and its innards are now exposed.

Since the present invention projectile device is filled with liquid, it is fairly dense for its size. Consequently, the projectile device can be thrown long distances with little effect from wind resistance. This makes the present invention device particularly useful for use with projectile launching assemblies, such as slingshots.

However, since the projectile device radically expands on impact with a surface, the force of the impact is distributed across a wide area. As a result, the present invention projectile device can be thrown against fragile surfaces, such as a pane of glass, without the projectile damaging that surface.

Figure 5:
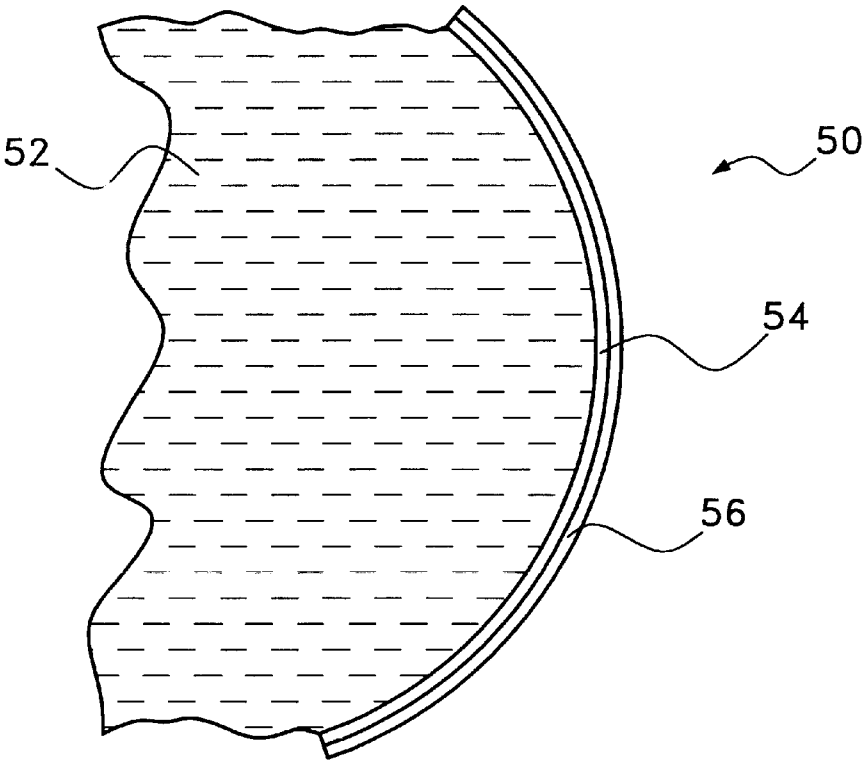
FIG. 5 is a crass-sectional view of a wall segment of a third exemplary embodiment of the present invention.

Referring now to FIG. 5, an alternate construction for the present invention projectile device 50 is shown. In previous embodiments the fill material within the projectile device was held in place by a single enveloping shell. Once the shell was cut, ripped or otherwise breaches, the fill material was free to exit the shell. In the embodiment of FIG. 5, multiple shell layers are used to confine the fill material 52 within the device 50. In the shown embodiment, the projectile device 50 has two separate shell layers 54, 56. However, it should be understood that any number of shell layers can be used.

In the shown embodiment, the inner shell layer 54 actually confines the fill material 52. The inner shell layer 54 is made from the elastomeric material previously described. However, the inner shell layer 54 need not be made to be tacky. Thus, in the composition of materials used in the manufacture of the inner shell layer 54, tacky resin need not be included.

However, a second shell layer 56 surrounds the first shell layer 54. The second shell layer 56 is the exterior layer of the projectile device 50. As such, the exterior shell layer 56 is the layer of material that will contact and adhere to an external surface. As a consequence, the external shell layer 56 is made to be tacky and thus does contain a tacky resin as part of its composition.

Figure 6:
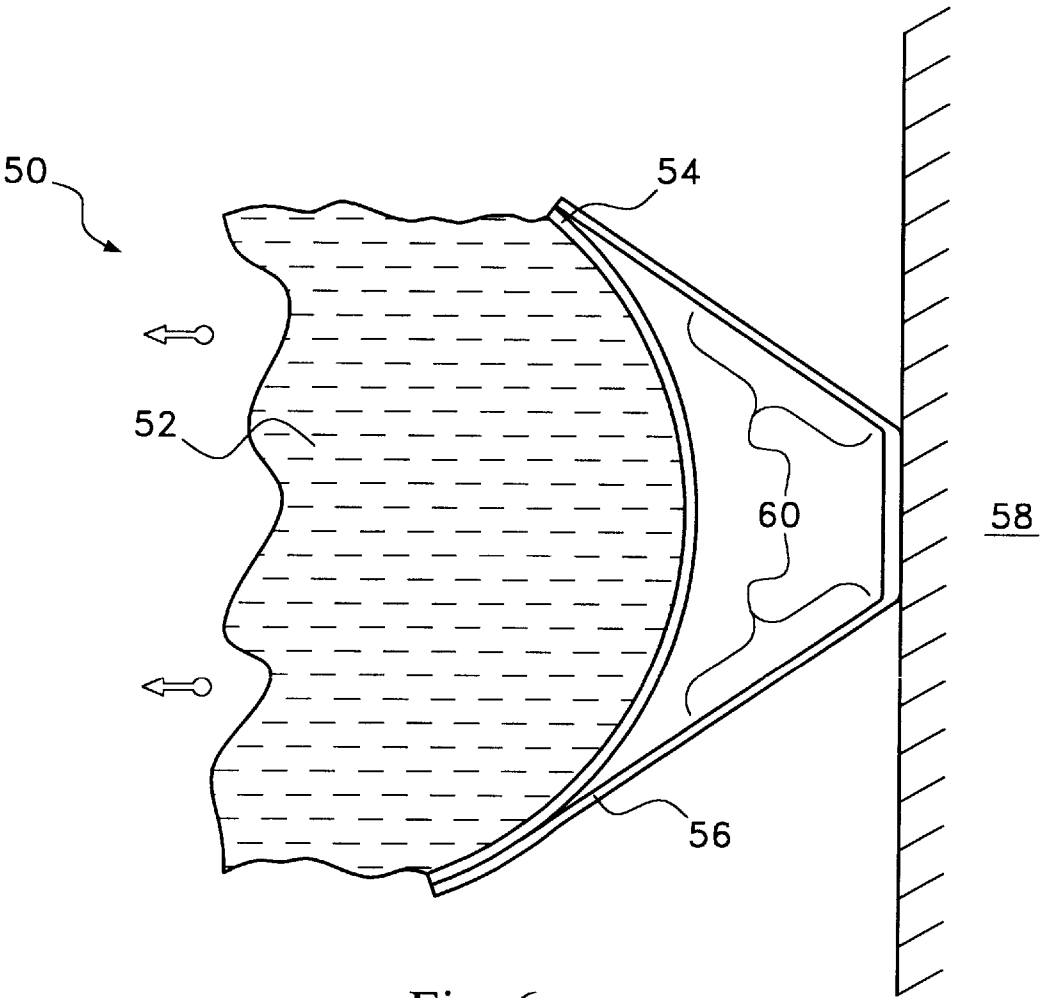
FIG. 6 shows the embodiment of FIG. 5 being pulled away from a surface against which it has just impacted.

Referring to FIG. 6, it can be seen that when the projectile device 50 is thrown against an external surface 58, the second shell layer 56 adheres to the impacted surface 58. If the projectile device 50 is rapidly pulled away from the impacted surface 58, the second shell layer 56 may become extremely stretched in between the portion of the second shell layer 56 that is adhered to the impacted surface 58 and the remaining body of the projectile device 50 that is being pulled away from the impacted surface 58. If projectile device 50 is pulled away from the impacted surface 58 with too much force, the stretched areas 60 may become stretched beyond their elastic limits. Accordingly, the stretched areas 60 may permanently become thinner than the remaining sections of the second shell layer 56. Similarly, small tears or holes may develop in the stretched areas 60. However, since the second shell layer 56 is not being used to retain the fill material 52, small holes in the second shell layer 56 do not effect the integrity of the first shell layer 54. The overall projectile device 50 therefore becomes more resilient and can be thrown harder than a projectile device with only a single shell layer. As a result, the functional life of the projectile device 60 is dramatically increased.

It will be understood that all of the embodiments of the present invention illustrated and described are merely exemplary and that the present invention can be practiced in a variety of different ways other than what is shown. For example, the shape and size of the elastomeric shell of the projectile device can be changed to the whims of the manufacturer. Similarly, the number of shell layers used and the objects placed within the shell layers can also be altered. All such modifications and alternate embodiments are intended to be covered by the scope of the claims presented below.

What is claimed is:

1. A projectile device, comprising:

a shell having an exterior surface and defining an internal chamber, said shell being fabricated from at least one layer of elastomeric material, wherein said exterior surface of said shell is tacky and temporarily adheres to hard surfaces against which it is thrown;

fill material disposed within said internal chamber, wherein said fill material includes a volume of fluid.

2. The device according to claim 1, wherein said fill material includes at least one solid object suspended in said volume of fluid.

3. The device according to claim 1, wherein said at least one layer of elastomeric material containing said exterior surface is made of a composition that includes at least one copolymer, a plasticizing oil and a tacky resin.

4. The device according to claim 3, wherein said copolymer is a tri-block copolymer.

5. The device according to claim 1, wherein said shell has a first maximum cross-sectional area at rest and expands to a second maximum cross-sectional area at least fifty percent as large as said first cross-sectional area when said shell is impacted against a hard surface at a speed in excess of ten miles per hour.

6. The device according to claim 1, wherein said at least one solid object is fabricated from soft material that will not rupture said shell.

7. The device according to claim 2, wherein said shell is shaped as an animal and said at least one object is shaped as an internal body part of said animal.

8. The device according to claim 1, wherein said shell is comprised of a plurality of layers of elastomeric material.

9. The device according to claim 1, wherein said exterior of said shell has a first color and said volume of liquid has a second different color.

10. A method of manufacturing a toy projectile, comprising the steps of:

fabricating a shell from at least one shell layer, wherein an exterior surface of said shell is made from a composition containing an elastomeric polymer, a plasticizing oil and a tacky resin, wherein said exterior surface of said shell is both elastic and tacky to the touch; and filling said shell with a fill material, wherein said fill material contains a predetermined volume of liquid.

11. The method according to claim 10, wherein said step of fabricating a shell includes fabricating a shell having elastic properties that enables said shell to increase in area by at least fifty percent when filled with said fill material and impacted against a hard surface at a speed of at least ten miles per hour.

12. The method according to claim 11, wherein said fill material contains solid objects mixed with said volume of fluid.

13. The method according to claim 11, wherein said step of fabricating a shell includes providing a shell with multiple independent shell layers.

14. The method according to claim 11, wherein said step of fabricating a shell includes fabricating a shell that is opaque when unstressed and translucent when stressed.

15. The method according to claim 14, wherein said shell is made in a first color and said volume of liquid has a second different color.

16. A toy projectile device comprising:

a volume of fill material containing at least some fluid;

a shell encapsulating said volume of fill material, said shell having a tacky external surface that temporarily adheres to a pane of glass when said toy projectile device is thrown against the pane of glass.

17. The device according to claim 16, wherein said shell is elastic and deforms into a deformed shape upon impact with the pane of glass, wherein said shell adheres to the pain of glass and retains said deformed shape for a predetermined period of time.

18. The device according to claim 16, wherein said fill material contains solid objects that are suspended in said fluid.

19. The device according to claim 16, wherein said shell is comprised of a composition containing an elastomeric polymer, a plasticizing oil and a tacky resin.

20. The device according to claim 16, wherein said shell is comprised of a plurality of separated shell layers.

* * * * *